US010723003B2

(12) United States Patent
East

(10) Patent No.: US 10,723,003 B2
(45) Date of Patent: Jul. 28, 2020

(54) MODULAR MOTORCYCLE TOOL KIT

(71) Applicant: Gordon H. East, Abbeville, AL (US)

(72) Inventor: Gordon H. East, Abbeville, AL (US)

( * ) Notice: Subject to any disclaimer, the term of this patent is extended or adjusted under 35 U.S.C. 154(b) by 199 days.

(21) Appl. No.: 15/951,158

(22) Filed: Apr. 11, 2018

(65) Prior Publication Data

US 2018/0290277 A1 Oct. 11, 2018

Related U.S. Application Data

(60) Provisional application No. 62/484,380, filed on Apr. 11, 2017.

(51) Int. Cl.

| | |
|---|---|
| ***B25B 27/00*** | (2006.01) |
| ***B25G 1/00*** | (2006.01) |
| ***B25G 3/06*** | (2006.01) |
| ***B25B 13/10*** | (2006.01) |
| ***B25F 1/02*** | (2006.01) |
| ***B25B 15/02*** | (2006.01) |
| ***B25B 15/00*** | (2006.01) |
| ***B25B 23/00*** | (2006.01) |

(52) U.S. Cl.

CPC ..... *B25B 27/0071* (2013.01); *B25B 13/107* (2013.01); *B25B 15/001* (2013.01); *B25B 15/02* (2013.01); *B25B 23/0035* (2013.01); *B25F 1/02* (2013.01); *B25G 1/005* (2013.01); *B25G 3/06* (2013.01)

(58) Field of Classification Search

CPC . B25B 27/0071; B25B 13/107; B25B 15/001; B25B 15/02; B25B 23/0035; B25F 1/02; B25G 1/005; B25G 3/06

USPC ..... 81/177.2

See application file for complete search history.

(56) References Cited

U.S. PATENT DOCUMENTS

| | | | | |
|---|---|---|---|---|
| 4,056,020 | A | 11/1977 | Coviello | |
| D298,101 | S | 10/1988 | Chen | |
| 4,960,016 | A * | 10/1990 | Seals | B25F 1/003 7/100 |
| 4,967,435 | A | 11/1990 | Seals | |
| 5,086,674 | A * | 2/1992 | Her | B25B 13/06 7/138 |
| 5,669,273 | A | 9/1997 | Huang | |
| 5,809,600 | A | 9/1998 | Cachot | |
| 6,062,111 | A | 5/2000 | Wershe | |
| D438,439 | S | 3/2001 | Compton | |
| 6,247,385 | B1 | 6/2001 | Wu | |
| 6,378,400 | B1 | 4/2002 | Bogli | |
| 6,378,402 | B1 | 4/2002 | Kalomeris et al. | |

(Continued)

*Primary Examiner* — Hadi Shakeri

(74) *Attorney, Agent, or Firm* — Memminger E. Wiggins

(57) ABSTRACT

A modular motorcycle tool kit comprising multiple tool drivers and a plurality of attachable tool components said kit being configured to address most motorcycle repair or service needs. Three drivers include apertures and special step-key shank slots to engage and receive a plurality of tool insert bits and fastener tool heads. The fastener tool heads are coupled to unique step-key shanks which are stronger, more robust, and less expensive to manufacture than comparative fastener tool head shanks. The drivers can be used separately or in conjunction with one another depending on the need of the user. The modular motorcycle tool kit is specifically designed and configured to be an invaluable modular motorcycle tool and at the same time occupy very little space on the motorcycle.

11 Claims, 8 Drawing Sheets

(56) References Cited

U.S. PATENT DOCUMENTS

| | | | | |
|---|---|---|---|---|
| 6,397,709 | B1 | 6/2002 | Wall | |
| 6,502,483 | B1 * | 1/2003 | Swank | B25B 13/56 7/138 |
| 6,606,925 | B1 | 8/2003 | Gmeilbauer | |
| 6,637,061 | B1 * | 10/2003 | Spracklin | B25B 13/48 7/138 |
| D482,586 | S | 11/2003 | Puerta | |
| 7,024,969 | B2 | 4/2006 | Smith | |
| 7,044,028 | B1 | 5/2006 | Lazano et al. | |
| 7,316,172 | B1 | 1/2008 | Chen et al. | |
| 8,051,748 | B2 | 11/2011 | Lin | |
| 8,096,213 | B2 | 1/2012 | Miers | |
| 8,667,870 | B2 | 3/2014 | Teper | |
| 9,193,058 | B2 | 11/2015 | Gallegos | |
| 9,498,870 | B2 | 11/2016 | Burri | |
| 2004/0163501 | A1 | 8/2004 | Chen | |
| 2006/0230885 | A1 | 10/2006 | Olson | |
| 2007/0251355 | A1 | 11/2007 | Kao | |
| 2010/0175514 | A1 | 7/2010 | Hsieh | |
| 2013/0098211 | A1 | 4/2013 | Sampson, Sr. | |

* cited by examiner

MODULAR MOTORCYCLE TOOL KIT

CROSS-REFERENCE TO RELATED APPLICATIONS

This application claims priority to and incorporates by reference herein U.S. Provisional Patent Application Ser. No. 62/484,380 filed on Apr. 11, 2017, and titled "Modular Motorcycle Tool Kit".

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO SEQUENCE LISTING, A TABLE, OR A COMPUTER PROGRAM LISTING SUBMITTED ON A COMPACT DISC WITH APPENDIX

Not Applicable.

FIELD OF THE INVENTION

The present invention, a modular motorcycle tool kit, relates to the field of tools, and more specifically to the field of tools used to address the specific challenges presented when servicing and repairing motorcycles and such other similar motorsports machines. The primary components of the modular motorcycle tool itself are configured and designed to be compactly stored and to perform multiple functions that cannot be achieved with customary tools. Additionally, the tool kit includes a variety of attachable tool components such as screw driver insert bits, hex key insert bits, star insert bits, socket adapters, tool head fasteners, pliers, and other such accessories as may be needed when servicing and/or repairing motorcycles and related motorsports machines.

Traditional hand wrenches are not designed to be compact, nor are such tools lightweight. Additionally, most commercially available hand wrenches are combination wrenches. Such wrenches have a fixed boxed configuration on one end and an open configuration on the other end with the size of both wrench configurations being the same. Separate boxed end wrenches and open-end wrenches having different sizes have not been commercially available since the 1970's. Therefore, a user must carry twice the number wrenches within the range of fasteners for the machine for which he is equipped. This twice the number of necessary wrenches is based on needing the same size wrench in both hands when engaging a fastener comprising both a nut and a bolt at opposing ends of such a fastener.

Generally, most hand wrenches of are of a fixed length and therefore create a compromising situation regarding a given wrenches' effectiveness. Choosing one specific wrench for its stored length leaves a user short on leverage and reach options when using such wrench. Likewise, choosing one specific wrench based on its desired usage results in limited storage options for that particular wrench.

Although a full set of wrenches may address most wrench needs, a full set adds additional weight due to the steel composition of the wrenches. A full set of wrenches also adds undesired bulk, because the wrench handles are often generally attached to the wrench ends. This additional bulk and weight duplication are inherent problems with the current wrench designs. Additionally, traditional wrench handles do not provide for extension leverage as may be needed when working with large fasteners.

SUMMARY OF THE INVENTION

Motorcycle travel and the service and repair of the motorcycle itself presents challenges that are not necessarily encountered with other motor vehicles. Unlike an automobile, a motorcycle does not have large compartments in which a rider can store personal items for travel or for storage of tools should the need for repair arise. Most motorcycles, all-terrain-vehicles, and watersport vehicles presently have a seat width and frame structure of approximately 7 inches. Generally, factory supplied tools for these vehicles, if so equipped, are designed to fit and store horizontally at a 90-degree angle under the seat. Although the present invention has a minimal packed size of about 6 inches×4 inches×2 inches, it provides a user 9 inches or more of hand wrench leverage and reach for the larger sized fasteners and their typical higher torque loads. The modular design of the fastener tool heads, such as wrench heads for the boxed end wrenches and the open-end wrenches, and pliers, allow for compact storage of the present modular motorcycle tool kit invention, but yet still provide duplicate sizing as found where both nuts and bolts of the same sizes are used at each end of a fastener. The modular fastener tool heads of the present invention can be made in a variety of metric and SAE sizes to accommodate many applications without changing the wrench drivers or screw/bit extension driver/third driver. Therefore, one object of the present invention is to provide compact storage of said invention and thereby overcome the space constraints for the stowing of tools encountered when traveling by motorcycle.

Unlike automobiles, the motorsport vehicles and machinery often use fasteners that employ both nuts and bolts where turning and/or the holding on two sides becomes necessary. The present invention permits a variety of wrench sizes and configurations. The present invention comprising two identical drivers, drivers one and two, and a single third driver which can be used alone or in concert with driver one or two which enables a user to configure wrenches of the same or different sizes for both hands as commonly required for adjustments and repairs for motorsport vehicles. Therefore, another object of the present invention is to provide a modular wrench kit that can be used with fasteners which employ both nuts and bolts at its opposing ends.

The service or repair of motorcycles, all-terrain-vehicles, and watersport vehicles most often occurs in very close and confined quarters. As such, each of the two drivers, drivers one and two, have small and large tool slots specifically suited for fastener tool head sizes within the tool set. The invention includes a third driver which can be used alone for utilizing various insert bits or in conjunction with the other drivers as an extension handle for increased tool length or torque.

The special shaping of each driver permits proper clearance and access as is needed in confined working areas. Additionally, the drivers have a magnetic retention system incorporated into their design for ease of use and secure holding/assembly of the forged fastener tool heads. The shape of the drivers are ergonomically designed and configured to fit the hand of the user and are specially designed to engage the third driver which also doubles as the screw driver and bit driver of the present invention. The third driver also provides for 90 degrees turning of a variety of screw driver insert bits, hex key insert bits, star insert bits, and socket drive adapters as needed for limited vertical access applications and/or where additional turning torque/force is needed to loosen and/or tighten a fastener.

Therefore, one object of the present invention is to provide a plurality of drivers designed and configured to be used in close quarters commonly encountered when servicing and/or repairing motorcycles, all-terrain-vehicles, and watersport vehicles.

Another object of the present invention is to provide a modular motorcycle tool kit that is lightweight and having its driver components made preferably from aluminum, but also conventional steels, steel alloys, or such other metals capable of providing lightweight strength.

Yet another object of the invention is to provide numerous combinations of fastener tool heads together with a variety of screwdriver insert bits, hex key bits, star insert bits, and socket drive adapters that can be easily and compactly stored.

Another object of the present invention is to provide a screw/bit and socket adapter driver that provides both direct (conventional) screwdriver movement and 90 degree-limited access/high torque application use while being designed for use as an extension driver to the other drivers comprising the present invention.

These and other objects of the present invention are achievable due to simple design and functional configuration of the present invention. These and other objects of the present invention can be obtained in the preferred embodiments of the invention described below.

DETAILED DESCRIPTION OF THE INVENTION

Figure 1A:
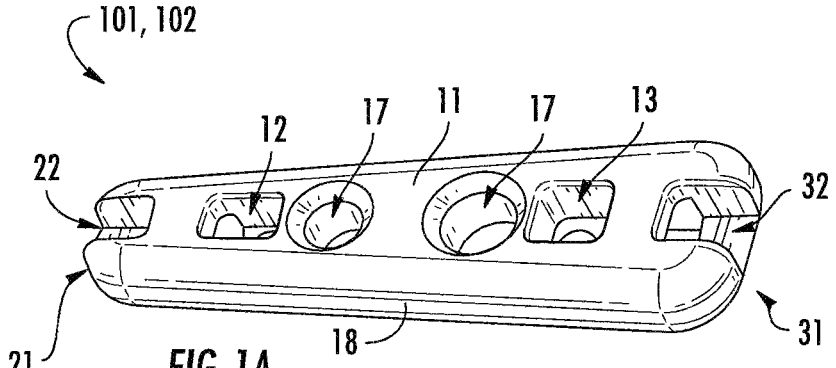
FIG. 1A is an upper perspective view of a first driver of the present invention, wherein a second driver being an exact duplicate of the first driver.
Figure 1B:
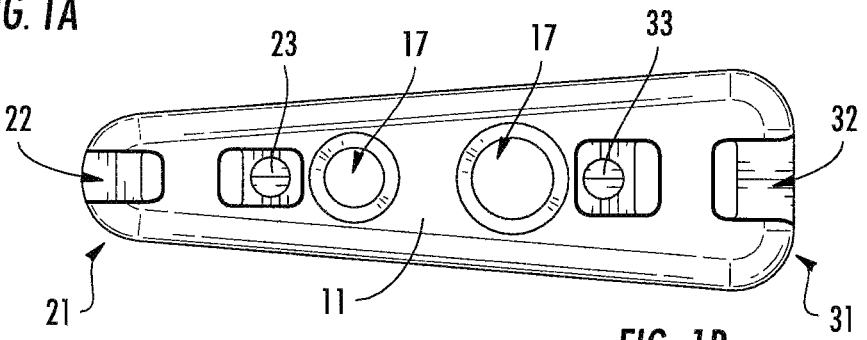
FIG. 1B is a top plan view of a first driver of the present invention, wherein a second driver being an exact duplicate of the first driver.
Figure 1C:
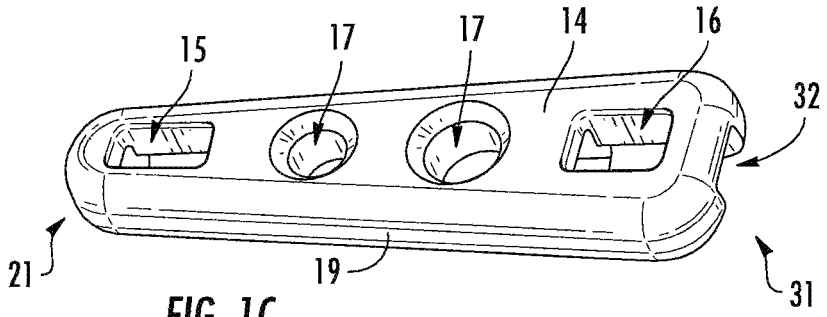
FIG. 1C is a lower perspective view of a first driver of the present invention, wherein a second driver being an exact duplicate of the first driver.
Figure 1D:
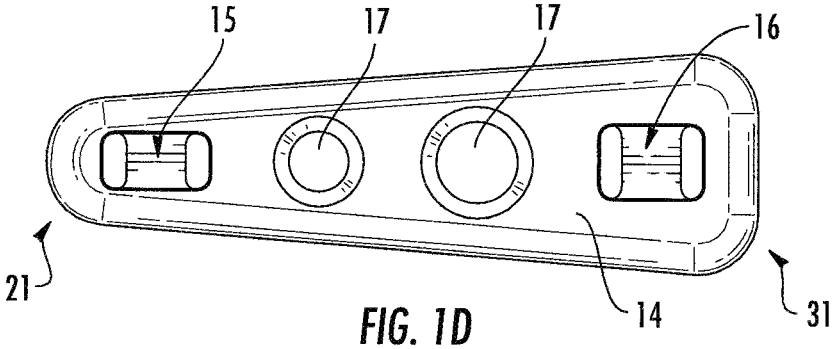
FIG. 1D is bottom plan view of a first driver of the present invention, wherein a second driver being an exact duplicate of the first driver.
Figure 1E:
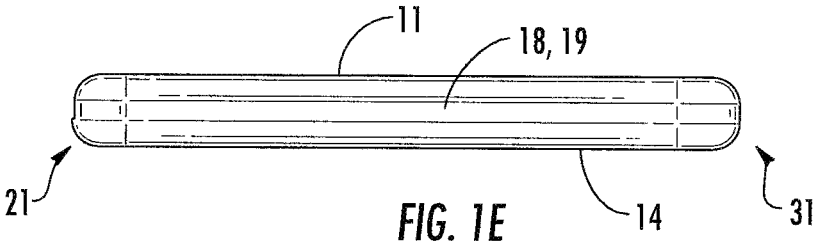
FIG. 1E is a side view of a first driver of the present invention, wherein a second driver being an exact duplicate of the first driver.
Figure 2A:
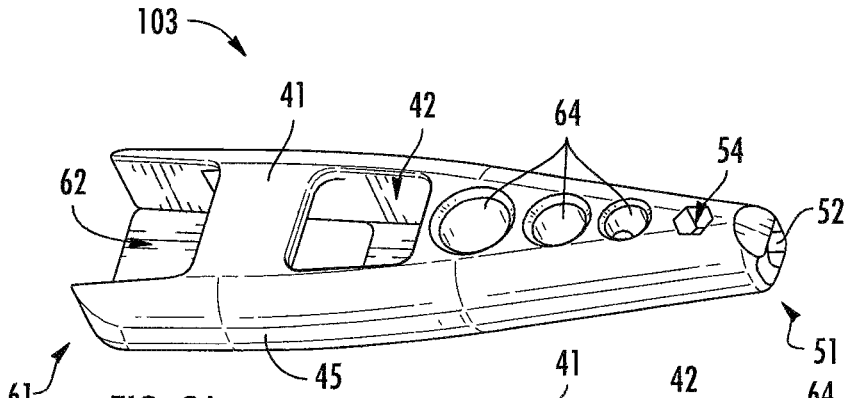
FIG. 2A is an upper perspective view of a third driver of the present invention.
Figure 2B:
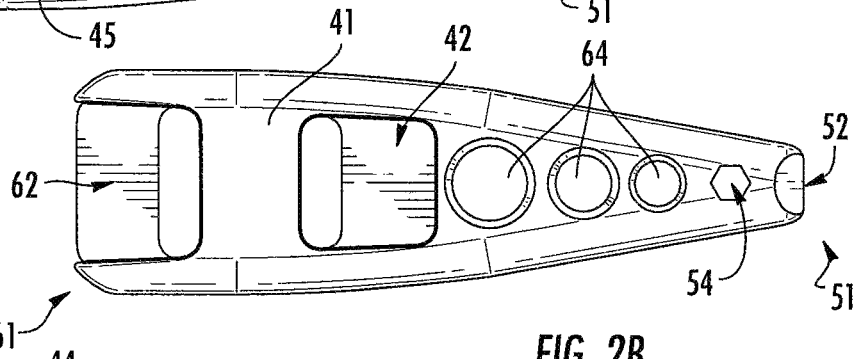
FIG. 2B is a top plan view of a third driver of the present invention.
Figure 2C:
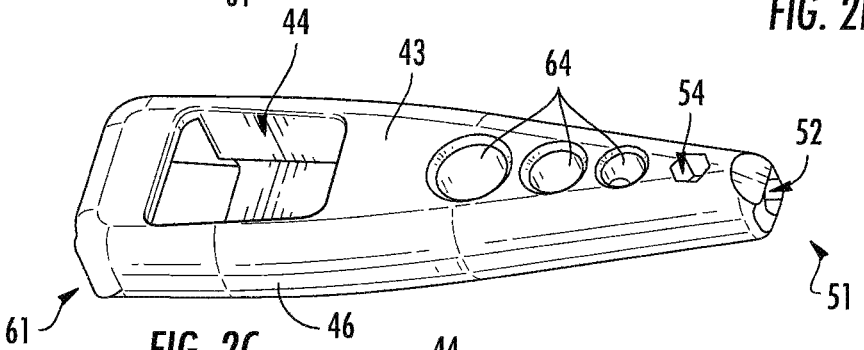
FIG. 2C is a lower perspective view of a third driver of the present invention.
Figure 2D:
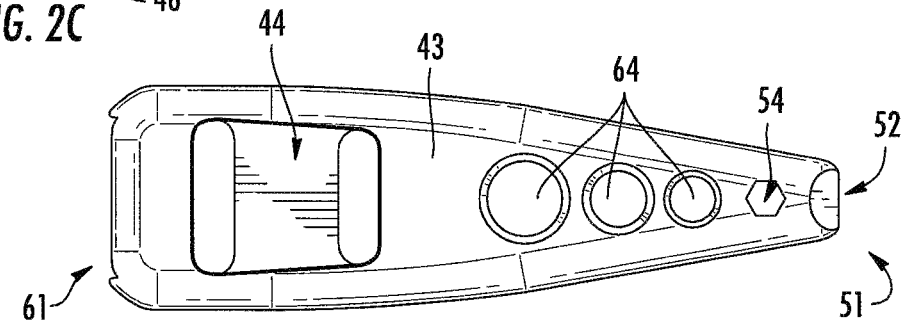
FIG. 2D is a bottom plan view of a third driver of the present invention.
Figure 2E:
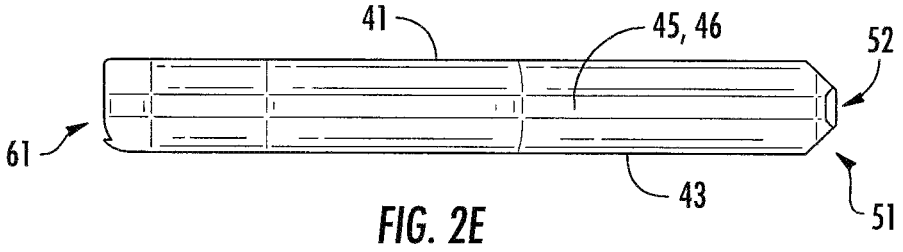
FIG. 2E is side view of a third driver of the present invention.
Figure 3A:
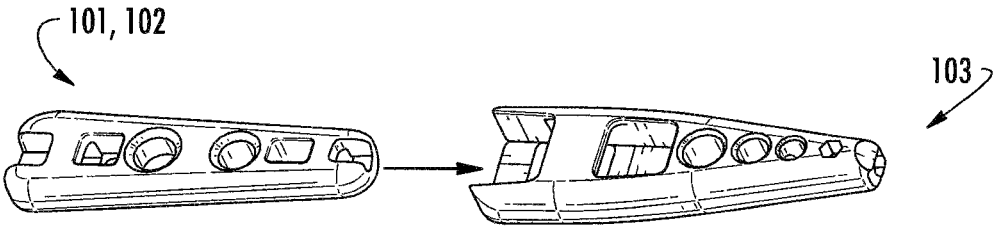
FIG. 3A is an upper perspective view of the present invention depicting a first driver and a third driver in alignment for operative association with one another.
Figure 3B:
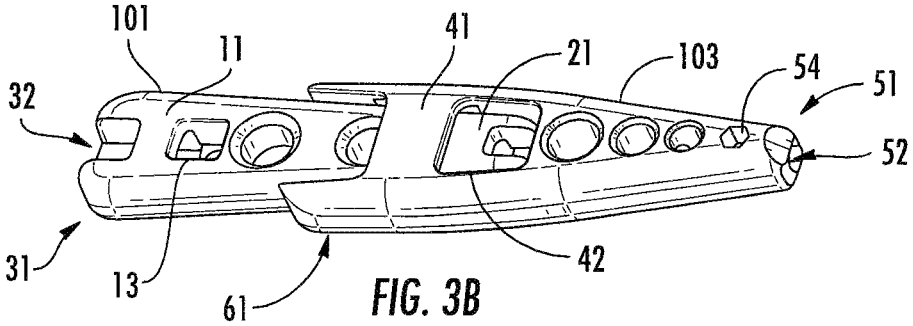
FIG. 3B is an upper perspective view of the present invention depicting a first driver and a third driver in operative association with one another.
Figure 3C:
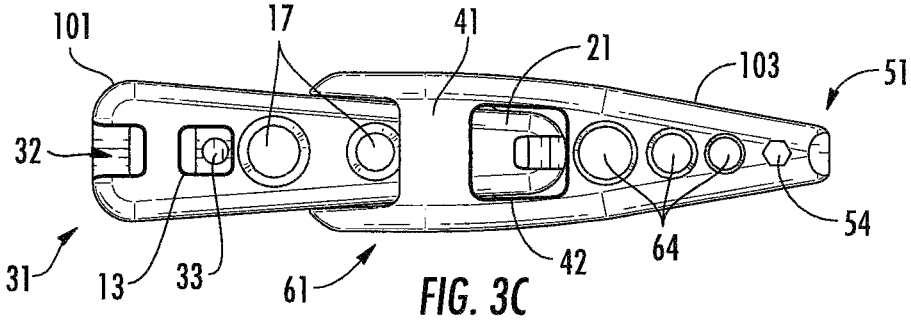
FIG. 3C is a top plan view of the present invention depicting a first driver and a third driver in operative association with one another.
Figure 3D:
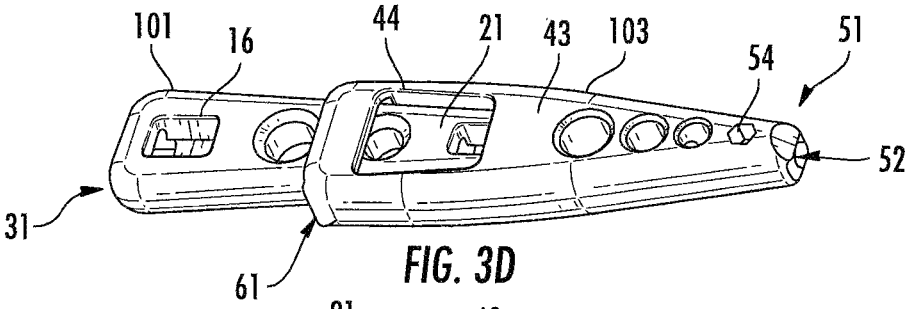
FIG. 3D is a lower perspective view of the present invention depicting a first driver and a third driver in operative association with one another.
Figure 3E:
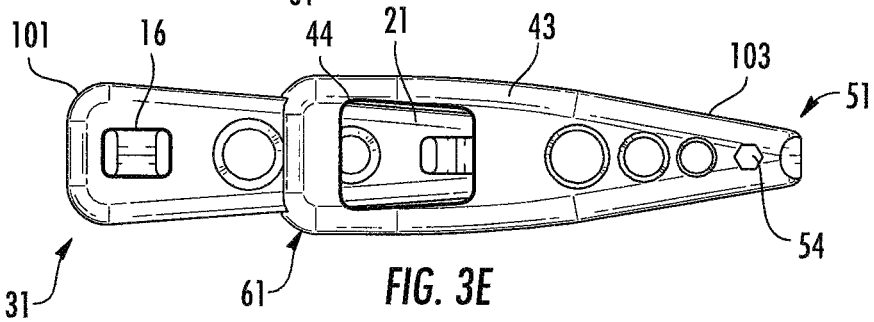
FIG. 3E is a bottom plan view of the present invention depicting a first driver and a third driver in operative association with one another.
Figure 4A:
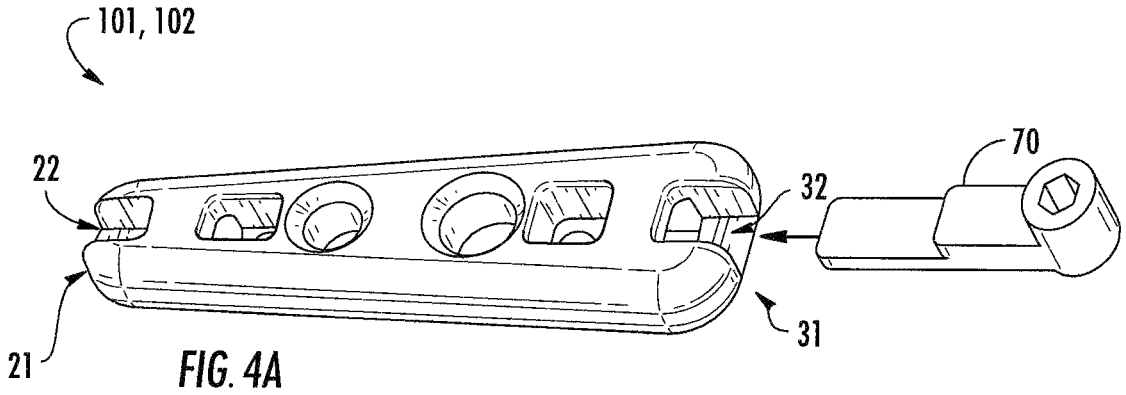
FIG. 4A is an upper perspective view of the present invention depicting a first driver and an insert bit driver in alignment for operative association with one another.
Figure 4B:
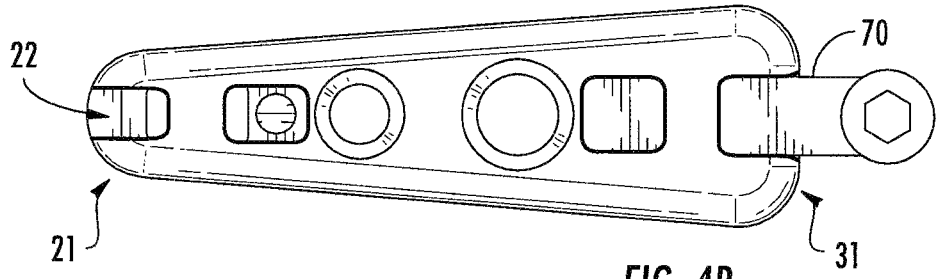
FIG. 4B is a top plan view of the present invention depicting a first driver and an insert bit driver in operative association with one another.

Reference will now be made in detail to one exemplary embodiment of the present invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the intended invention. Other objects, features, and aspects of the present invention are disclosed in the following detailed description. It is to be understood by one of ordinary skill in the art that the present discussion is a description of one exemplary embodiment only and is not intended as limiting the broader aspects of the present invention.

In describing the various figures herein, the same reference numbers are used throughout to describe the same material or apparatus, or process pathway. To avoid redundancy, detailed descriptions of much of the apparatus once described in relation to a figure is not repeated in the descriptions of subsequent figures, although such apparatus or process is labeled with the same reference numbers.

A modular motorcycle tool kit according to a preferred embodiment of the present inventions is illustrated in FIGS. 1 to 13. One exemplary embodiment of the present invention can be generally described as a modular tool kit for the repair and service of motorcycles and related motorsports machines comprising certain specially designed and configured primary components such as a first driver 101, a second driver 102 being an exact duplicate of the first driver, a third driver 103, an extension bit holder 73, an insert bit driver 70, and a plurality of fastener tool heads 91, the fastener tool heads being coupled to a specifically designed and configured step-key shank 81 adapted to engage the first driver 101, second driver 102, third driver 103, and insert bit driver 70 as may be determined by a user. The specially designed primary components of the present invention also permit the use of a plurality of tool insert bits, socket adapters, fastener tool heads. In addition to the tool components of the present invention, the present invention also includes a specifically designed tool kit case to compactly house the plurality of tool components to permit storage within the limited confines found on a motorcycle or such other vehicle with very limited storage space. The present invention provides As seen in references to FIGS. 1 to 13, in accordance with the present invention a modular motorcycle tool kit is provided herein comprising a first driver 101, a second driver 102, a third driver 103, an extension bit holder 73, an insert bit driver 70, a plurality of attachable tool components 91, 92, 93, 94, and a tool kit case 201. Now referring to FIGS. 1A, 1B, 1C, 1D, and 1E, the first driver 101 comprising a top surface 11 having first and second top surface portals 12, 13 and a bottom surface 14 that is parallel to the top surface 11 and having first and second bottom surface portals 15, 16, first and second sides 18, 19 that are perpendicular to the top and bottom surfaces 11, 14 and connect the top surface 11 to the bottom surface 14. Additionally, the first driver 101 includes a tapered first end 21 defining a first step-key shank slot 22 in which a first retention magnet 23 is housed, a second end 31 defining a second step-key shank slot 32 which houses a second retention magnet 33, and a plurality of tapered circular apertures 17 traversing perpendicularly from the top surface 11 to the bottom surface 14 of said first driver 101. The overall shape of each first and second driver 101, 102 being wider at its second end 31 and decreasing in width to its tapered first end 21 and having an overall triangular shape. The presence, diameter, and position of the tapered circular apertures 17 are important in regard to each driver's weight, balance, and manufacturing. The physical specifications of the first and second drivers 101, 102 include a length ranging from about 3 inches to about 6 inches, a thickness ranging from about 0.375 inches to about 0.75 inches, a width ranging from about 1.0 inch to about 1.75 inches at its second end 31 and decreasing in a tapered manner to its tapered first end 21 having a width ranging from about 0.5 inches to about 1.0 inches. However, in a preferred embodiment of the present invention the physical specifications of the first and second drivers 101, 102 include a length of about 4.75 inches, a thickness of about 0.5 inches, a width of about 1.25 inches at its second end 31 and decreasing in a tapered manner to its tapered first end 21 having a width of about 0.794 inches. The weight of the first and second drivers 101, 102 is minimized due to its design and configuration, but also the materials from which it is manufactured, preferably aluminum, but also conventional steels, steel alloys, or such other metals capable of providing lightweight strength.

Referring to FIGS. 2A, 2B, 2C, 2D, and 2E, the present invention includes a third driver 103 comprising, a top surface 41 having a top surface portal 42, a bottom surface 43 being parallel to said top surface 41 and having a bottom surface portal 44, first and second sides 45, 46 perpendicular to said top and bottom surfaces 41, 43 and connecting said top and bottom surfaces 41, 43. Additionally, the third driver 103 includes a tapered first end 51 defining a first hexagonal tool aperture 52 housing a retention magnet at the closed end of the hexagonal tool aperture, a second hexagonal tool aperture 54 adjacent to said tapered first end 51 traversing perpendicularly from the top surface 41 to the bottom surface 43 of said third driver 103, and a second end 61 defining a driver receiving slot 62 being configured to frictionally receive the tapered first end 21 of said first or second drivers 101, 102 into said driver receiving slot 62 to provide increased operational, length and leverage for the first hexagonal tool aperture 52, the second hexagonal tool aperture 54, and the second step-key shank slot 32 of the first and second drivers 101, 102. Similar to the first and second drivers 101, 102, the overall shape of the third driver 103 being wider at its second end 61 and decreasing in width to its tapered first end 51 and having an overall triangular shape. Also similar to the first and second drivers 101, 102, the third driver 103 comprising a plurality of tapered circular apertures 64 traversing perpendicularly from the top surface 41 to the bottom surface 43 of said third driver 103 where the presence, diameter, and position of the tapered circular apertures 64 are important in regard to the third driver's weight, balance, and manufacturing. The physical specifications of the third driver 103 include a length ranging from about 3 inches to about 7 inches, a thickness ranging from about 0.375 inches to about 0.875 inches, a width ranging from about 1 inch to about 2 inches at its second end 61 and decreasing in a tapered manner to its tapered first end 51 having a width ranging from about 0.375 inches to about 0.75 inches. However, in a preferred embodiment of the present invention the physical specifications of the third driver 103 include a length of about 5 inches, a thickness of about 0.65 inches, a width of about 1.5 inches at its second end 61 and decreasing in a tapered manner to its tapered first end 51 having a width of about 0.5 inches.

Figure 5A:
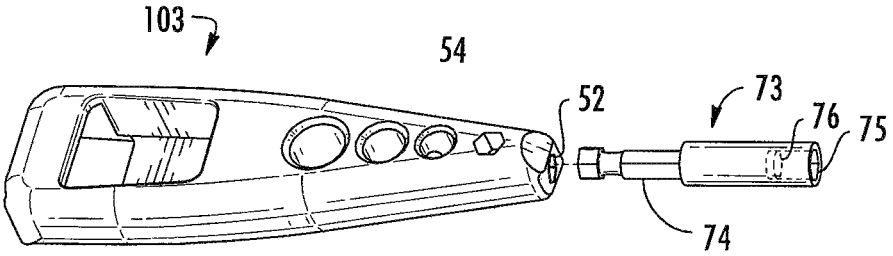
FIG. 5A is an upper perspective of the present invention depicting a third driver and an extension bit holder in alignment for operative association with one another.
Figure 5B:
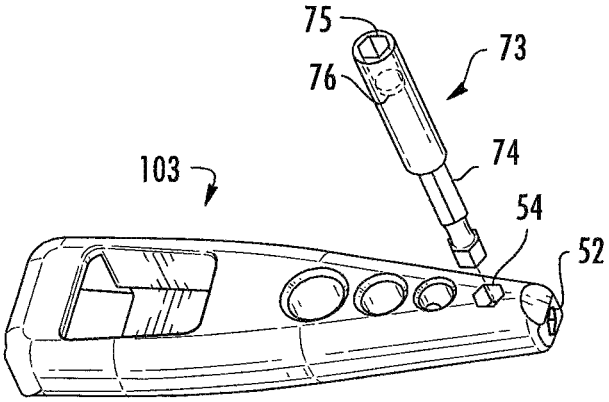
FIG. 5B is an upper perspective of the present invention depicting a third driver and an extension bit holder in alignment for operative association with one another.
Figure 6A:
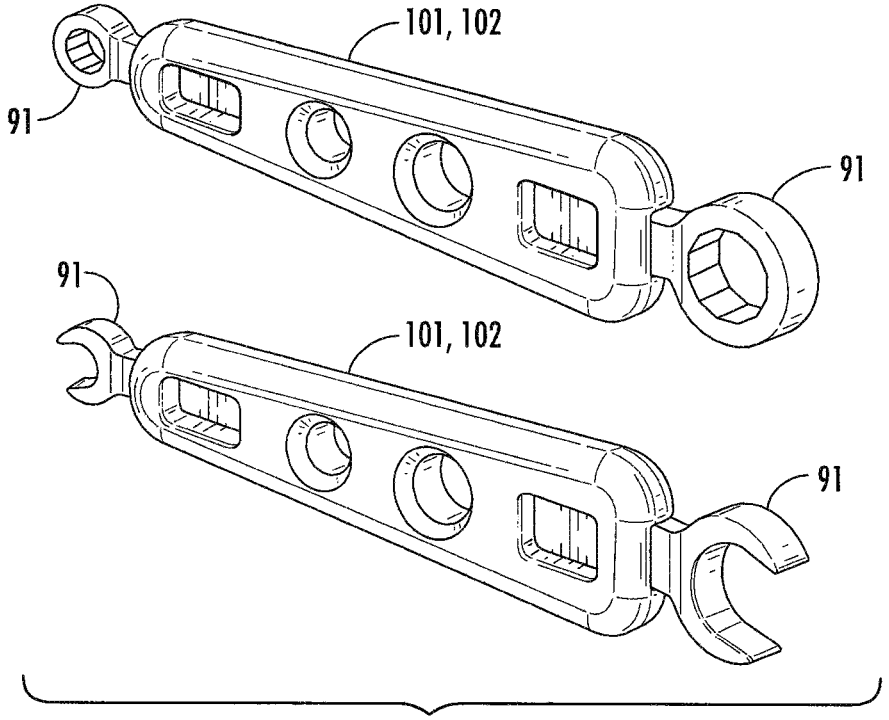
FIG. 6A illustrates lower perspective views of two exemplary embodiments for the present invention depicting a first driver, a second driver, and fastener tool heads in operative association with one another.
Figure 6B:
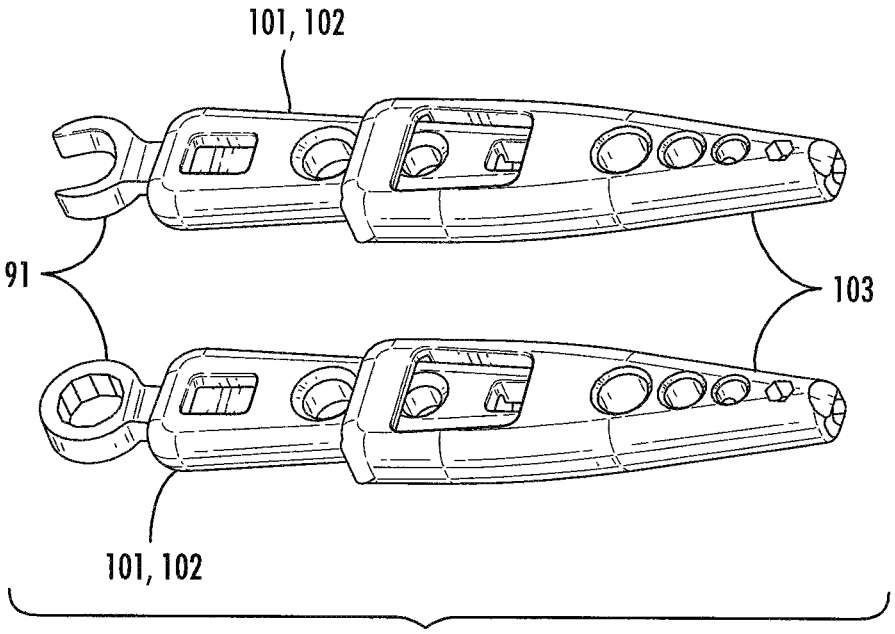
FIG. 6B is a lower perspective view of two exemplary embodiments for the present invention depicting a first driver, a third driver, and fastener tool heads-in operative association with one another.
Figure 7:
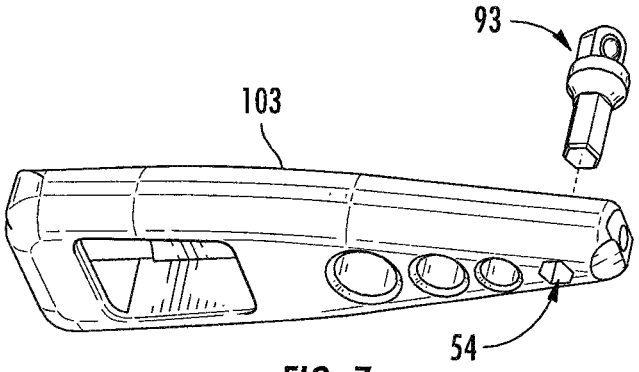
FIG. 7 provides a lower perspective of the present invention depicting a third driver and a socket adapter in operative association alignment with one another.
Figure 8:
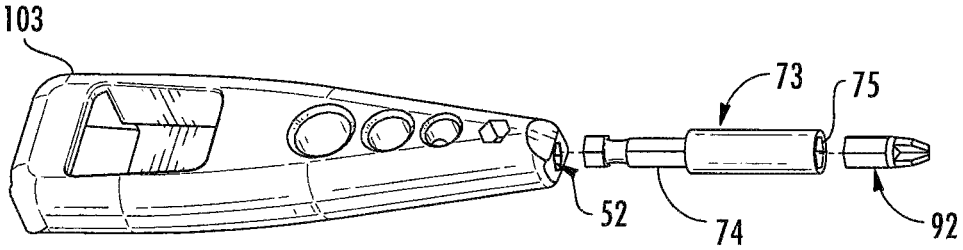
FIG. 8 provides a lower perspective of the present invention depicting a third driver, an extension bit holder, and screw driver insert bit in operative association with one another.

Now referring to FIG. 5A, 5B, 8, the present invention comprising an extension bit holder 73 having a hexagonal shank 74 at its proximal end and a hexagonal socket 75 housing a retention magnet 76 at is distal end. The hexagonal shank 74 being designed and configured to engage the first hexagonal tool aperture 52 of said third driver 103. As shown in FIG. 4A, 4B, 10A, 10B, 11A, 11B, 12A, 12B, the present invention includes an insert, bit driver 70 having a step-key shank 81 that is designed and configured to engage said second step-key shank 32 slot of the first and second drivers 101, 102.

Referring to FIGS. 4A, 4B, 5A, 5B, 6A, 6B, 7, 8, 9A, and 9B, the present invention includes a plurality of attachable tool components 91, 92, 93, 94 designed and configured for selective use with the first driver 101, the second driver 102, the third driver 103, the extension bit holder 73, and the insert bit driver 70. In a preferred embodiment of the present invention, the plurality of attachable tool components adapted to engage the hexagonal socket 75 of said extension bit holder 73 (for use in conjunction with the first hexagonal tool aperture 52 and the second hexagonal tool aperture 54 of the third driver 103) and the insert bit driver 70 (for use in conjunction with the second step-key shank slot 32 of said first and second drivers 101, 102) include a plurality of screw driver insert bits, a plurality of hex key insert bits, a plurality of star insert bits, and a plurality of socket adapters. The screw driver insert bits include a cross point #3 JIS ¼"×25 mm insert bit, a cross point #2 JIS ¼"×25 mm insert bit, a cross point #1 JIS ¼"×25 mm insert bit, a slotted 8 mm ¼"×25 mm insert bit, slotted 6 mm ¼"×25 mm insert bit, and a slotted 4 mm ¼"×25 mm insert bit. The hex key insert bits include a 4 mm hex key ¼"×25 mm insert bit, a 5 mm hex key ¼"×25 mm insert bit, a 6 mm hex key ¼"×25 mm insert bit, and a 8 mm hex key ¼"×25 mm insert bit. The star insert bits include a T50 ¼"×25 mm star insert bit, a T45 ¼"×25 mm star insert bit, a T40 ¼"×25 mm star insert bit, a T30 ¼"×25 mm star insert bit, a T27 ¼"×25 mm star insert bit, a T25 ¼"×25 mm star insert bit, and a T20 ¼"×25 mm star insert bit. The socket adapters include a socket adapter ¼" hex drive for ¼" square sockets×25 mm insert bit and a socket adapter ¼" hex drive for ⅜" square sockets×25 mm insert bit.

Figure 9A:
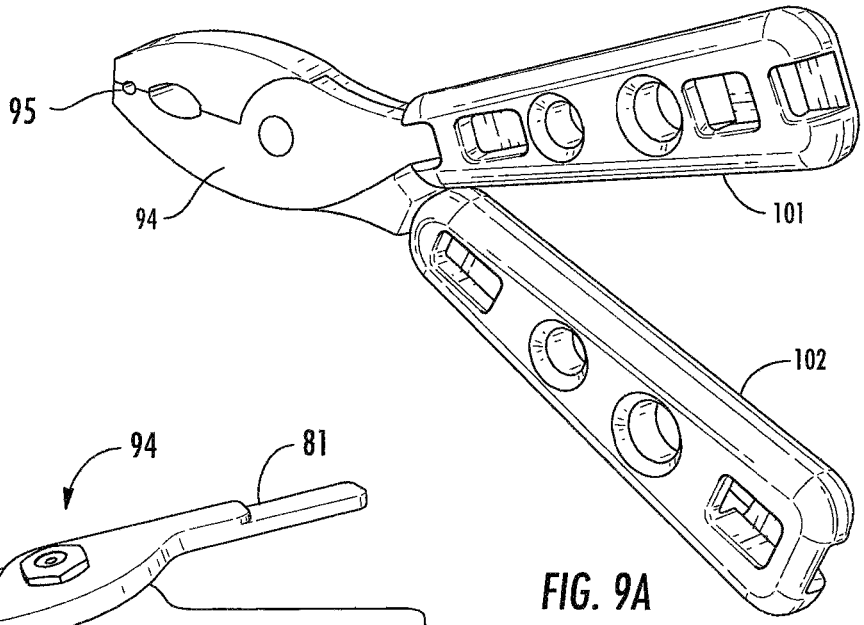
FIG. 9A is a lower perspective view of the present invention depicting a first driver, a second driver, and a plier tool head in operative association, with one another.
Figure 9B:
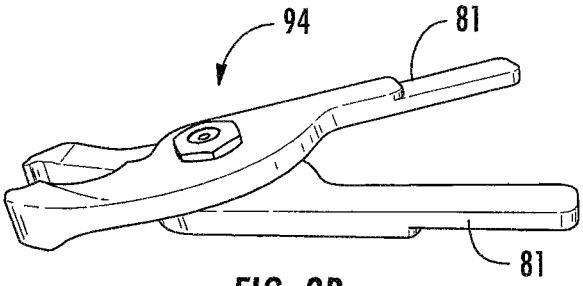
FIG. 9B is a perspective view of the present invention depicting a plier tool head coupled with a pair of step-key shanks.
Figure 10A:
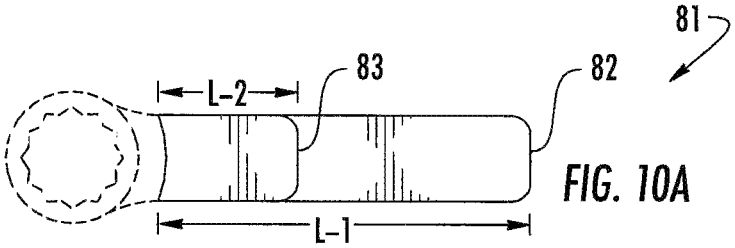
FIG. 10A is a top plan view of a first driver step-key shank coupled to a boxed tool head fastener.
Figure 10B:
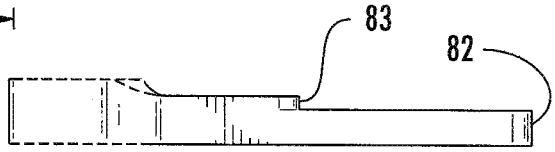
FIG. 10B is a side view of a first driver step-key shank coupled to a boxed tool head fastener.
Figure 11A:
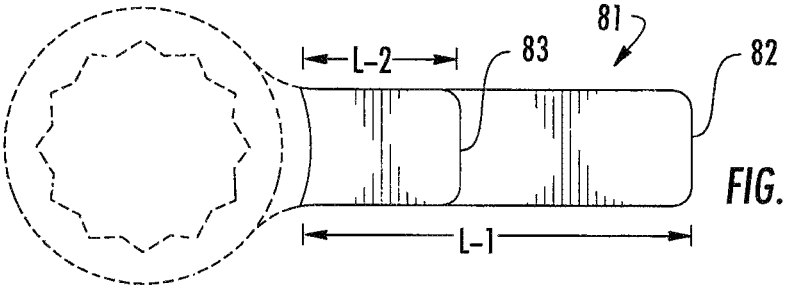
FIG. 11A is a top plan view of a second driver step-key shank coupled to a boxed tool head fastener.
Figure 11B:
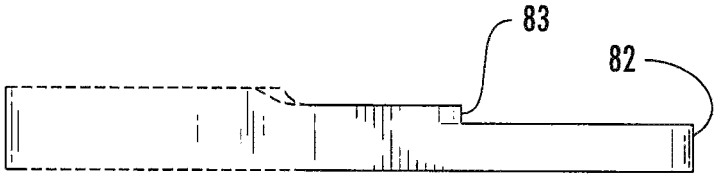
FIG. 11B is a side view of a second driver step-key shank coupled to a boxed tool head fastener.
Figure 12A:
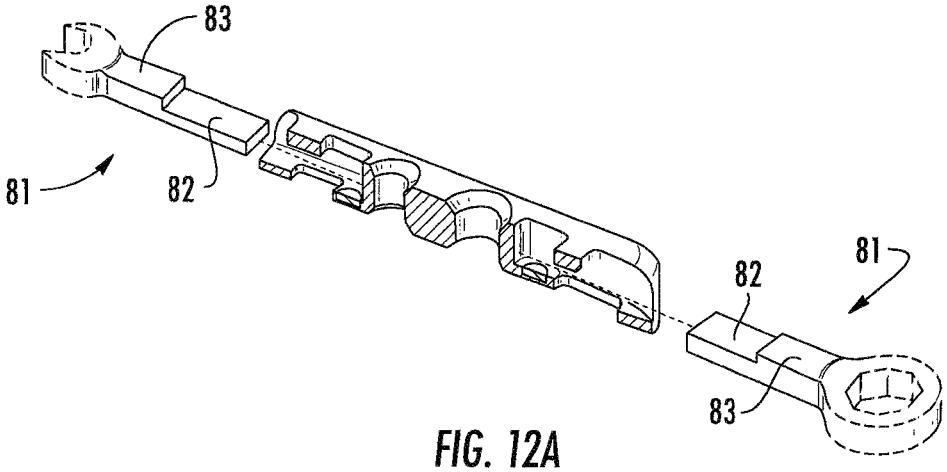
FIG. 12A is a cross-sectional upper perspective view of the present invention depicting an open tool head fastener, a first driver, and a boxed tool head fastener is operative association alignment with one another.
Figure 12B:
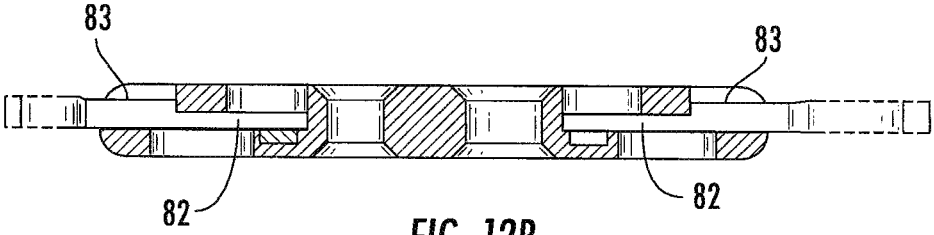
FIG. 12B is a cross-sectional side view of the present invention depicting an open tool head fastener, a first driver, and a boxed tool head fastener is operative association alignment with one another.

Now referring to FIGS. 6A, 6B, 9A, 9B, 10A, 10B, 12A, and 12B, the plurality of attachable tool components of the present invention includes a plurality of fastener tool heads 91 coupled to a step-key shank 81 adapted to engage said first step-key shank slot 22 of said first and second drivers 101, 102. In a preferred embodiment of the present invention a step-key shank 81 adapted to engage said first step-key shank slot 22 of said first and second drivers 101, 102 having dimensions comprising a lower step 82 length of about 1.4 inches (FIG. 10A, L-1) and an upper step 83 length of about 0.525 inches (FIG. 10A, L-2) for each step as measured from a proximate end of the step-key shank 81 coupled to the fastener tool head collar to a distal end of the lower step 82 and the distal end of the upper step 83. The width of both the upper step 83 and the lower step 82 of the step-key shank 81 being about 0.315 inches. The height of the lower step 82 of the step-key shank 81 being about 0.125 inches and the height of the lower step 82 together with the upper step 83 of the step-key shank being about 0.188 inches. The design and configuration of step-key shank 81 results in a more robust and stronger unit with better engagement between the fastener tool head's step-key shank 81 and the step-key shank slots 22, 32 on the first and second drivers 101, 102. Referring to FIGS. 9A and 9B, the above beneficial features of the step-key shank are even more apparent with the plier tool head attachment as a result of asymmetrical configuration of the step-key shanks 81 connected to the plier head 94. The plier head 94 of the present invention is designed and configured to enable its user to grab/push chain master clips and to grab/hold cotter pins, both of which are often found on and used with many motorsports machines. This unique feature is due to half circle groove 95 that traverses the width of the plier's upper and lower jaw. Additionally, the step-key shank is actually more economical to manufacture due to less machining production time. In a preferred embodiment of the present invention the plurality of fastener tool heads include an 8 mm boxed tool head fastener, an 8 mm open tool head fastener, a 10 mm boxed tool head fastener, a 10 mm open tool head fastener, a 12 mm boxed tool head fastener, a 12 mm open tool head fastener, a 13 mm boxed tool head fastener, a 13 mm open tool head fastener, and a pliers tool head 94.

Now referring to FIGS. 6A, 6B, 9A, 9B, 11A, 11B, 12A, and 12B the plurality of attachable tool components of the present invention includes a plurality of fastener tool heads 91 coupled to a step-key shank 81 adapted to engage the second step-key shank slot 32 of said first and second drivers 101, 102. In a preferred embodiment of the present invention a step-key shank 81 adapted to engage said second step-key shank slot 32 of said first and second drivers 101, 102 having dimensions comprising a lower step 82 length of about 1.4 inches (FIG. 11A, L-1) and an upper step 83 length of about 0.525 inches (FIG. 11A, L-2) for each step as measured from a proximate end of the step-key shank 81 coupled to the fastener tool head collar to a distal end of the lower step 82 and the distal end of the upper step 83. The width of both the upper step 83 and the lower step 82 of the step-key shank 81 being about 0.435 inches. The height of the lower step 82 of the step-key shank 81 being about 0.175 inches and the height of the lower step 82 together with the upper step 83 of the step-key shank 81 being about 0.244 inches. In a preferred embodiment of the present invention the plurality of fastener tool heads includes a 14 mm boxed tool head fastener, a 14 mm open tool head fastener, a 17 mm boxed tool head fastener, and a 17 mm open tool head fastener.

Figure 13A:
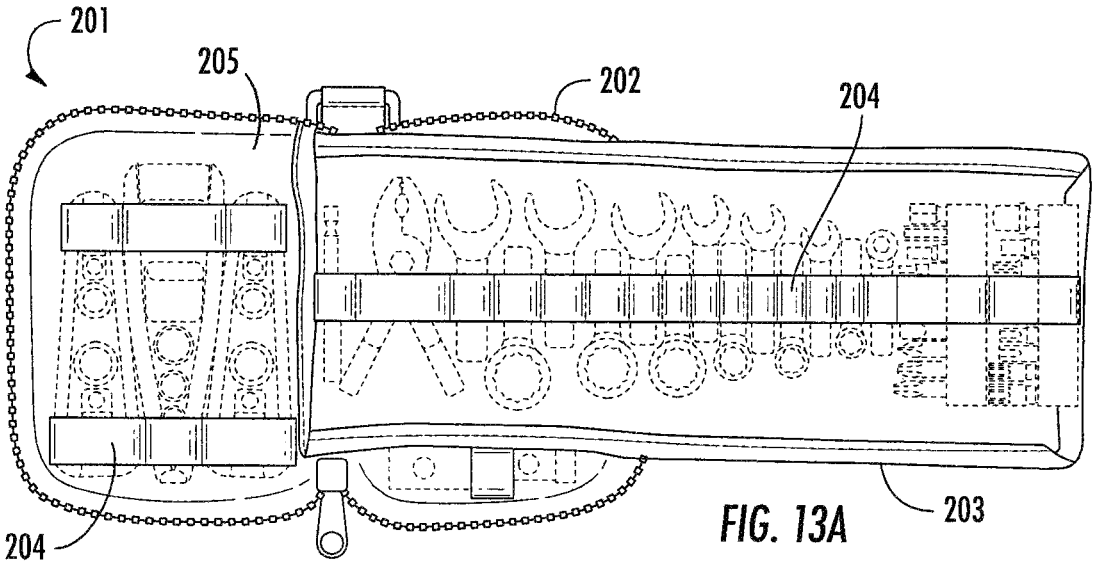
FIG. 13A is an open view of the present invention depicting an interior configuration of tool components in a tool kit case.
Figure 13B:
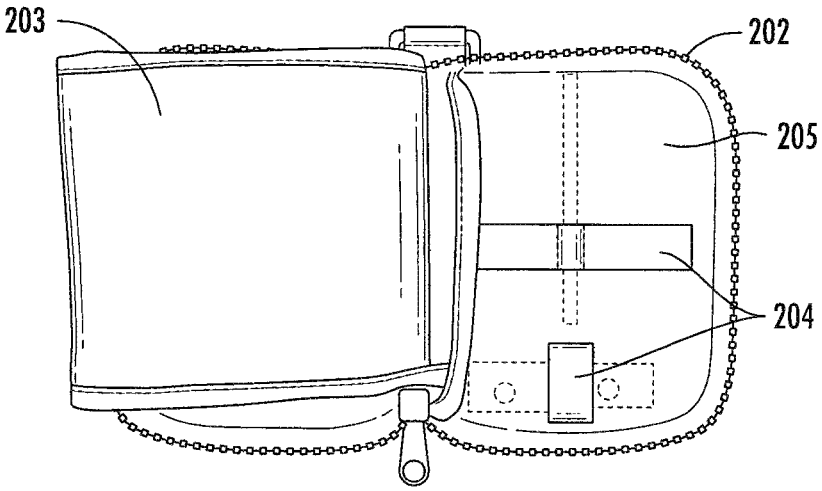
FIG. 13B is an open view of the present invention depicting a folded configuration of tool components in a tool kit case.
Figure 13C:
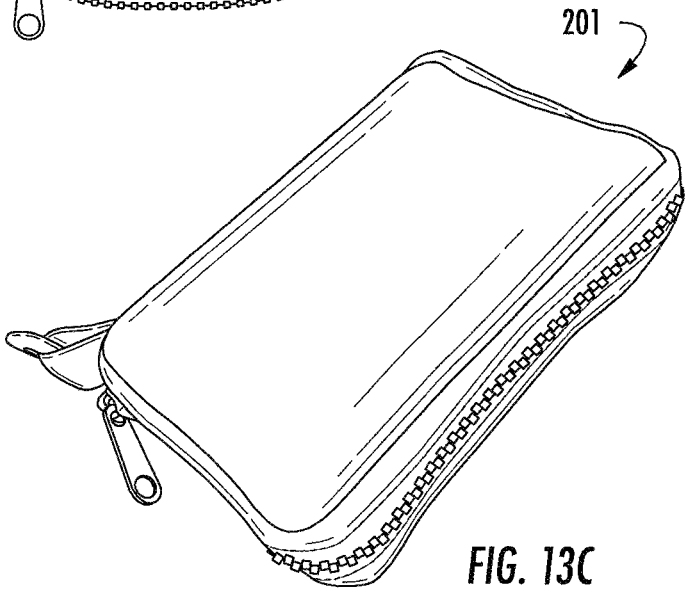
FIG. 13C is an upper perspective view if the present invention depicting a closed tool kit case.

The present invention provides includes a tool kit case which is designed and configured to be house in the limited storage space on motorcycles and such other similar vehicles. Referring to FIGS. 13A, 13B, and 13C, in one preferred embodiment the present invention provides for a re-closable tool kit case 201 generally rectangular in shape defining an interior providing at least two opposing interior walls 205. The tool kit case is manufactured from durable, but pliable material so that the tool kit case can conform to the shape of its confined environment. The tool kit case unzips 202 along three sides dividing the case into two compartments connected by a fabric fold line. Attached to the fold line is a fold-out section 203 having two sides that extends a length. A length of elastic banding 204 is attached to and traverses along the middle of said foldout section from about the fabric fold line to about the opposite end of the foldout section such that a plurality of loops are formed the length of the fold-out section. The elastic banding is also attached to two opposing interior walls 205 of the top and bottom of the case. The placement of the stitching to secure the elastic banding is such that the loops formed can secure tools within the tool kit case until removed by a user to repair or service a motorcycle or such other vehicle. For durability and strength, the tool kit case can be made from nylon fabric, or such other materials capable of providing such features. Although a zipper closing means is the preferred embodiment, other fasteners such as snaps and hook and loop fasteners.

To use the present invention, a modular motorcycle tool, a user first selects the appropriate attachable tool component to address the task at hand. The selected tool component is next paired with the appropriate driver. Often driver selection may be determined the nature of the task and the amount of space available within which the tool is to be used. Fastener tool heads will be paired with the first and/or second driver(s). The size of the tool head fastener needed for the task will dictate if the fastener tool head shank is inserted into the first step-key shank slot or the second step-key shank slot of the first and/or second driver. Once the fastener tool head shank of the proper tool component is inserted into to the proper driver, a user can proceed to tighten or loosen the fastener or the like.

In similar fashion to the use of fastener tool heads, if the task at hand requires'a screw driver insert bit (or other kind of insert bit) the user will initially select the appropriate insert bit for the task to be addressed. The insert bit will generally be inserted into the hexagonal socket of the extension bit holder and depending on the type of work to be performed and the space within which the modular tool is to be used, the user will determine if the shank of the insert bit holder is inserted into the first hexagonal tool aperture of the third driver or into the second hexagonal tool aperture and therefore perpendicular to the plane of the third driver. The selection and use of the other tool components (i.e., pliers, spark plug socket shown in dashed lines in FIG. 13B, socket adapters) of the present invention typically proceeds as discussed above.

The unique design and configuration of the present invention permits a user to work on motorcycle and related motorsports machines fasteners having a nut/bolt on each end of the fastener by utilizing each of the drivers of the present invention with the appropriate fastener tool heads. In the event additional torque or reach or length is needed when using the present invention, the tapered first end of the first or second driver is inserted into the driver slot of the third driver to frictionally engage the driver receiving slot of the third driver.

The length, width, thickness, and configuration of the present invention permits its use in the close and confined environments typically encountered when servicing/repairing a motorcycle other such vehicles including all-terrain-vehicles and water sport vehicles. The present invention therefore serves a need that traditional tools have failed to meet.

Although preferred embodiments of the present invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged either in whole, or in part. Therefore, the spirit and scope of the invention should not be limited to the description of the preferred embodiments contained herein.

What is claimed is:

1. A modular motorcycle tool kit comprising:

a first driver adapted for use as a first tool handle, said first driver comprising a top surface having first and second top surface portals, a bottom surface being parallel to said top surface and having first and second bottom surface portals, first and second sides perpendicular to said top and bottom surfaces and connecting said top and bottom surfaces, a tapered first end defining a first step-key shank slot housing a first retention magnet, a second end defining a second step-key shank slot housing a second retention magnet, and a plurality of tapered circular apertures traversing perpendicularly from the top surface to the bottom surface of said first driver;

a second driver adapted for use as a second tool handle in conjunction with said first driver, wherein said second driver being an exact duplicate of said first driver;

a third driver adapted for use as a third tool handle and as an extension in conjunction with said first driver and second drivers comprising a top surface having a top surface portal, a bottom surface being parallel to said top surface and having a bottom surface portal, first and second sides perpendicular to said top and bottom surfaces and connecting said top and bottom surfaces, a tapered first end defining a first hexagonal tool aperture housing a retention magnet, a second hexagonal tool aperture adjacent to said tapered first end traversing perpendicularly from the top surface to the bottom surface of said third driver, a second end defining a driver receiving slot being configured to frictionally receive the tapered first end of said first or second drivers into said driver receiving slot to provide increased operational length and leverage for the first hexagonal tool aperture, the second hexagonal tool aperture, and the second step-key shank slot of the first and second drivers, and a plurality of tapered circular apertures traversing perpendicularly from the top surface to the bottom surface of said third driver;

an extension bit holder having a hexagonal shank at its proximal end and a hexagonal socket housing a retention magnet at is distal end wherein said hexagonal shank being designed and configured to engage the first hexagonal tool aperture of said third driver;

an insert bit driver having a step-key shank configured to engage said second step-key shank slot of said first and second drivers;

a motorcycle sparkplug socket tool;

a plurality of attachable tool components designed and configured for selective use with said first driver, said second driver, said third driver, said extension bit holder, and said insert bit driver; and a re-closeable tool kit case adapted to compactly store said first driver, said second driver, said third driver, said extension bit holder, said insert bit driver, said motorcycle sparkplug socket tool, and said plurality of attachable tool components.

2. The modular motorcycle tool kit of claim 1, wherein said plurality of attachable tool components include a plurality of screw driver insert bits, a plurality of hex key insert bits, a plurality of star insert bits, and a plurality of socket adapters, said attachable tool components being adapted to engage the extension bit holder for use with the first hexagonal tool aperture and the second hexagonal tool aperture of said third driver and to engage the insert bit driver for use with the second step-key shank slot of said first and second drivers.

3. The modular motorcycle tool kit of claim 2, wherein said plurality of screw driver insert bits comprising a cross point #3 JIS ¼"×25 mm insert bit, a cross point #2 JIS ¼"×25 mm insert bit, a cross point #1 JIS ¼"×25 mm insert bit, a slotted 8 mm ¼"×25 mm insert bit, slotted 6 mm ¼"×25 mm insert bit, and a slotted 4 mm ¼"×25 mm insert bit.

4. The modular motorcycle tool kit of claim 2, wherein said plurality of hex key insert bits comprising a 4 mm hex key ¼"×25 mm insert bit, a 5 mm hex key ¼"×25 mm insert bit, a 6 mm hex key ¼"×25 mm insert bit, and a 8 mm hex key ¼"×25 mm insert bit.

5. The modular motorcycle tool kit of claim 2, wherein said plurality of star insert bits comprising a T50 ¼"×25 mm star insert bit, a T45 ¼"×25 mm star insert bit, a T40 ¼"×25 mm star insert bit, a T30 ¼"×25 mm star insert bit, a T27 ¼"×25 mm star insert bit, a T25 ¼"×25 mm star insert bit, and a T20 ¼"×25 mm star insert bit.

6. The modular motorcycle tool kit of claim 2, wherein said plurality of socket adapters comprising a socket adapter ¼" hex drive for ¼" square sockets×25 mm insert bit and a socket adapter ¼" hex drive for ⅜" square sockets×25 mm insert bit.

7. The modular motorcycle tool kit of claim 1, wherein said plurality of attachable tool components include a plurality of fastener tool heads coupled to a step-key shank adapted to engage said first step-key shank slot of said first and second drivers.

8. The modular motorcycle tool kit of claim 7, wherein said plurality of fastener tool heads comprising an 8 mm boxed tool head fastener, an 8 mm open tool head fastener, a 10 mm boxed tool head fastener, a 10 mm open tool head fastener, a 12 mm boxed tool head fastener, a 12 mm open tool head fastener, a 13 mm boxed tool head fastener, a 13 mm open tool head fastener, and a pliers tool head.

9. The modular motorcycle tool kit of claim 1, wherein said plurality of attachable tool components include a plurality of fastener tool heads coupled to a step-key shank adapted to engage said second step-key shank slot of said first and second drivers.

10. The modular motorcycle tool kit of claim 9, wherein said plurality of fastener tool heads comprising a 14 mm boxed tool head fastener, a 14 mm open tool head fastener, a 17 mm boxed tool head fastener, and a 17 mm open tool head fastener.

11. The modular motorcycle tool kit of claim 1, wherein said tool kit case defines a plurality of interior surfaces to which lengths of elastic banding is stitched forming a plurality of loops to secure said first driver, said second driver, said third driver, said extension bit holder, said insert bit driver, said motorcycle sparkplug socket tool, and said plurality of attachable tool components.

* * * * *